United States Patent [19]

Slator et al.

[11] 3,987,858

[45] Oct. 26, 1976

[54] HYDROMECHANICAL DRILLING JAR

[75] Inventors: Damon T. Slator; Archie W. Peil; Thomas R. Bishop, all of Houston, Tex.

[73] Assignee: Bowen Tools, Inc.

[22] Filed: June 23, 1975

[21] Appl. No.: 589,058

[52] U.S. Cl. ..... 175/297

[51] Int. Cl.[2] ..... E21B 1/10

[58] Field of Search ..... 175/297, 300, 302, 304

[56] References Cited

UNITED STATES PATENTS

| | | | |
|---|---|---|---|
| 2,659,576 | 11/1953 | Linney | 175/297 |
| 3,429,389 | 2/1969 | Barrington | 175/297 |
| 3,562,807 | 2/1971 | Slator et al. | 175/297 |
| 3,853,187 | 12/1974 | Sutliff et al. | 175/297 |
| R23,354 | 4/1951 | Storm | 175/297 |

OTHER PUBLICATIONS

Bowen Hydromechanical Drilling Jars; 1974–1975 General Catalog, p. 666–B.

*Primary Examiner*—James A. Leppink
*Attorney, Agent, or Firm*—Pravel & Wilson

[57] ABSTRACT

An improved hydromechanical drilling jar for applying upward and downward jarring blows to an object stuck in a well wherein the jar comprises a mechanically operated jar section which is connected with a hydraulically operated jar section by flexible tubular connector means for providing flexibility therebetween for relieving bending moments on the jar sections during use. The jar sections are separable for ease in storage and transportation and may be relatively positioned in a drill string as desired.

4 Claims, 8 Drawing Figures

10a
10
J1
18
17
12
20
20a
22
22b
26
24
10b
19
19a
A1
12b
15
15a
15b
10d
12c
14b
14
32
P
14a
30
16
12a
M

M
52a
50c
J2
55
62a
62
60a
60
50
52
80
81
79
70b
72
F
74
70
70a
76
78
A2
54
58a
58
57a
57
56
52d
52c
50c
59
50a 70b
74b
F
74g
70
74j
74e
74i
72a
72
72b
74h
74f
74g
74j
74
74e
74c
74i
74g
72a
72
74f
72b
74h
74d
74j
74g
74e
74i
72a
72
72b
74a
70a
76b
76a
76

12
10
14
14a
14b
32
10d
40e
P
40d
40
42c
40b
42d
42
40a
10c
40f
42b
40c
42a
44a
44
4
4
30

12
42b
40g
42
40c
10
42b
40f
5
5

40f
40c
40

HYDROMECHANICAL DRILLING JAR

BACKGROUND OF THE INVENTION

The field of this invention is related to drilling jar tools for applying a jarring blow to an object stuck in a well such as a stuck pipe or fish.

Heretofore, drilling jar tool systems including means for hydraulically developing an up-blow and means for mechanically developing a down-blow to an object stuck in a well have conventionally been constructed in a single structure. See, for example, U.S. Pat. No. 3,853,187. Such two-way hydromechanical jars, however, suffer from the disadvantage of having relatively long lengths required for housing the respective operational parts of the hydraulic and mechanical means provided within telescopically related longitudinally movable inner and outer tubular members. The relatively long length is disadvantageous inasmuch as it subjects the working parts of the tool to excessive bending moments which may be encountered in the well which may damage or jam such working parts. Moreover, due to the relatively long length such tools have heretofore been constructed with relatively thick-walled tubular elements which are substantially inflexible subjecting such tools to sticking or jamming in many well bores such as slant well bores.

Additionally, these relatively long single structure jarring tools are difficult to handle during the running of a drill string and are extremely cumbersome to transport.

SUMMARY OF THE INVENTION

With the present invention, the problems of inflexibility and excessive length of such single structure two-way jarring tools and the sticking of such tools in a well bore have been solved by providing a two-way hydromechanical drilling jar which comprises a hydraulically operated jar section adapted to deliver an upward jarring blow, a mechanically operated jar section adapted to deliver a downward jarring blow and means for connecting the jar sections to each other and for providing flexibility to the jar to relieve excessive bending moments on the jar sections which may be encountered in the well. The respective jar sections of the invention are separable for ready transportation and storage as relatively short members and are adapted to be connected in the drill string at any desired reversible position relative to each other.

DESCRIPTION OF THE PREFERRED EMBODIMENTS

Figure 1A:
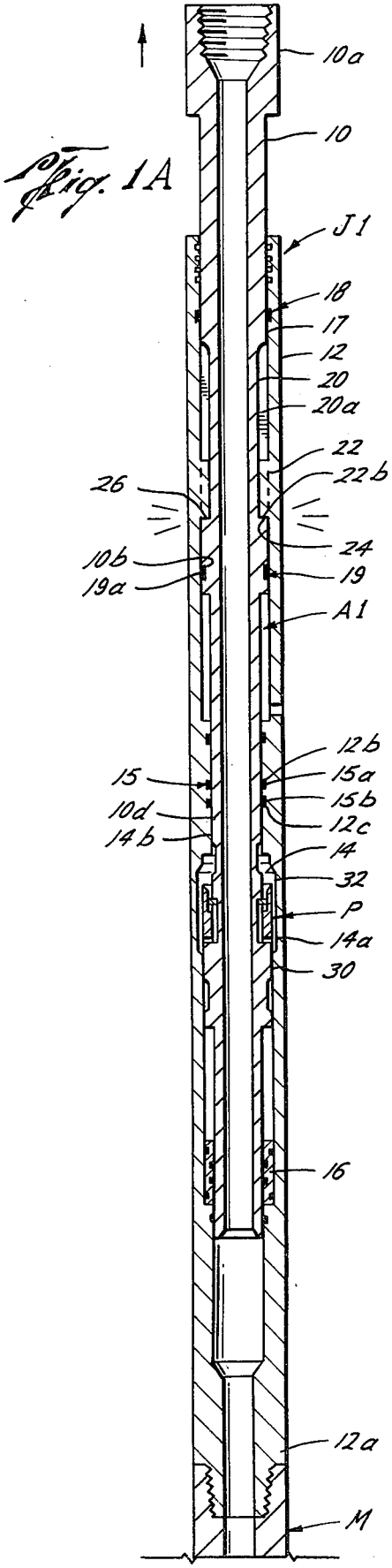
FIG. 1A is a vertical cross-sectional, partial cut-away view of the present invention, illustrating the hydraulically operated jar section in the fully extended or jarring position.

Referring now to the drawings in greater detail, the hydromechanical drilling jar of the present invention includes the hydraulically operated jar section, generally designated as J1, a mechanically operated drilling jar section, generally designated as J2, and a means M for connecting the respective jars J1 and J2 to each other. Both of the jar tools J1 and J2 are comprised of inner and outer telescopically arranged tubular elements 10, 12 and 50, 52, respectively. The tubular elements 10, 12 are adapted for longitudinal movement relative to each other from an extended position (FIG. 1A) to a telescopical position (FIG. 2A) and form between them annular space A1. The hydraulic jar section inner tubular body 10 has an upper end **10*a* which is threaded or otherwise adapted for connection with a drill pipe or tube string (not shown) or other portion of a drilling string which normally extends downwardly into a well for lowering, raising and operation of the jar combination of the invention. The hydraulic jar outer tubular element 12 has a lower end 12*a*** which is threaded or otherwise adapted for connection with the connecting means M.

Similarly, the inner tubular elements 50, 52 are adapted for relative longitudinal movement from a telescopical position (FIG. 2B) to an extended position (FIG. 1B) and form an annular space A2 therebetween.

The mechanical jar outer tubular element 52 has a threaded upper end **52*a* adapted for connecting with the means M and the inner tubular element 50 has a lower end 50*a*** which is threaded and adapted for connection with a lower section of the drill string and/or any suitable grapple or the like which may be connected to an object to be jarred in the well such as a stuck pipe or fish.

One of the primary advantages of the drilling tool combination of the present invention is that the hydraulically operated jar section J1 and the mechanically operated jar section J2 may be positioned separately relative to each other in the drill string at substantially any desired position if desirable. The jar sections may be employed as connected together whereby the hydraulic jar section outer tubular element lower end **12*a* is connected to the mechanical jar section outer tubular element upper end 52*a*. Alternatively, the positioning of the jar sections J1 and J2 may be reversed in the drill string such as by connection of the lower end 50*a* with the upper end 10*a*. Further, the jar sections may be spaced relative to each other in the drill string wherein the connection means M may include one or more joints of drill pipe or the like between the jar sections J1 and J2 to impart flexibility therebetween so as to provide flexible relief to excessive bending moments which may be encountered in the well, particularly where the jar of the invention is employed in slant wells or the like. Such flexibility reduces the chances of the telescopically related tubular elements 10, 12 and 50, 52,** respectively, from jamming or sticking during relative longitudinal movement.

Figure 1B:
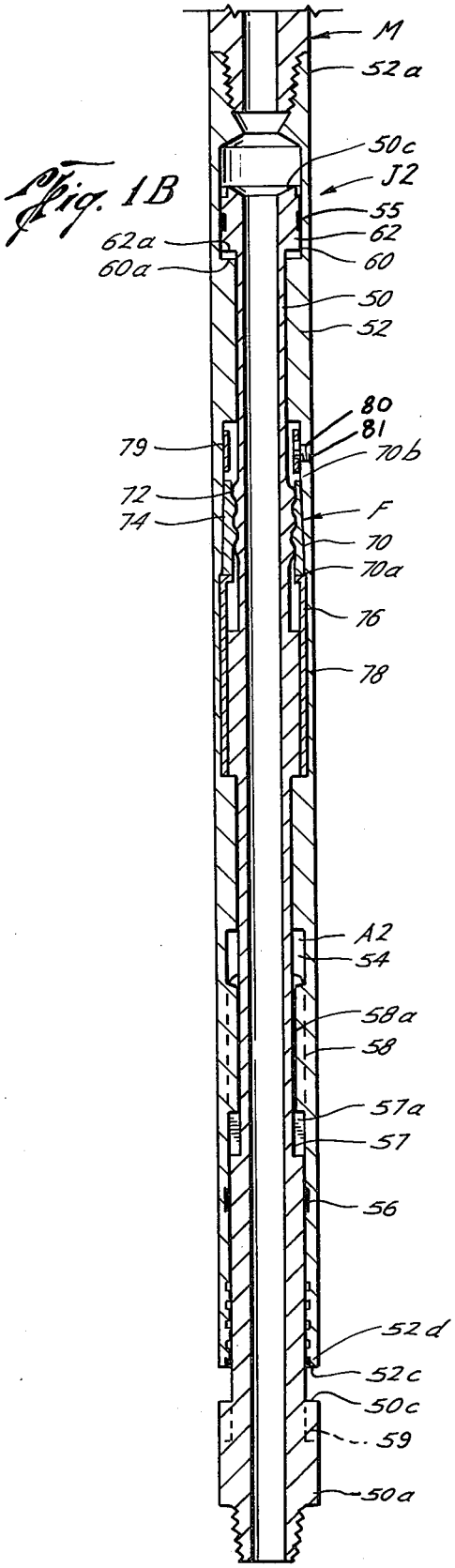
FIG. 1B is vertical cross-sectional, partial cut-away view of the present invention, illustrating the mechanically operated jar section in its fully extended or operational starting position.
Figure 2A:
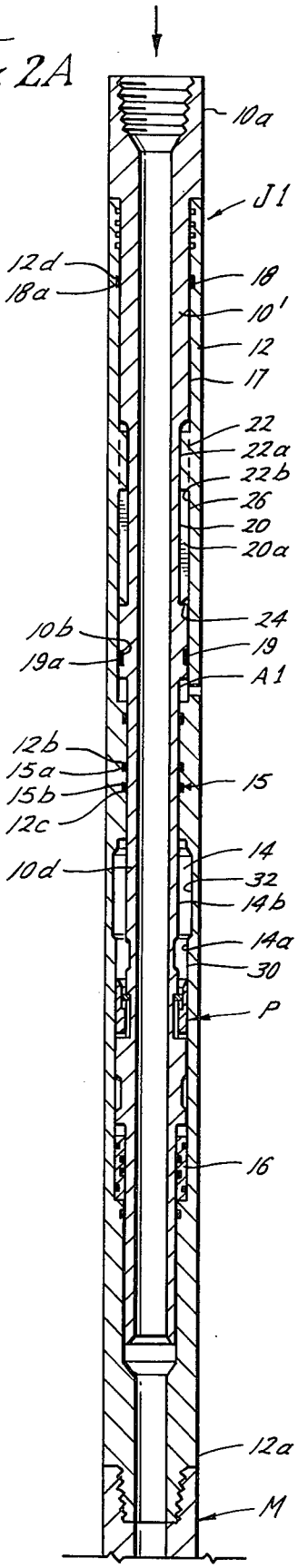
FIG. 2A is a cross-sectional vertical, partial cut-away view of the present invention, illustrating the hydraulically operated jar section in its telescopical or operational starting position.

Referring now to FIGS. 1A and 2A, the hydraulically operated jar section J1 is provided with a first fluid or hydraulic chamber 14 in the annular space A1 between the inner and outer tubular elements 10, 12. The first fluid chamber is defined by a first pair of seal means 15, 16 which are disposed between the inner and outer tubular elements 10, 12 in a fluid sealing arrangement and are spaced longitudinally relative to each other. Preferably, the seal means 15 includes a plurality of upper annular seals **15*a*, 15*b* received in a plurality of inwardly opening annular internal grooves 12*b*, 12*c* provided on the outer tubular element 12. The upper seals 15*a*, 15*b* are preferably formed of any conventional seal material, such as rubber, teflon, or the like, preferably with O-rings, and slidably engage the inner tubular element 10** forming a fluid tight seal therebetween.

The lower seal means 16 is preferably disposed between the inner and outer tubular elements 10, 12 in slidable engagement therewith in a "floating" arrangement and forming a fluid tight seal with both elements 10, 12. This lower "floating" seal 16 is thus capable of moving upwardly and downwardly relative to both tubular elements 10, 12 to provide pressure equalization within the first annular fluid chamber 14 relative to the well pressure during operation of the jar J1. The lower floating seal 16 is formed of suitable seal material such as rubber, teflon or the like and also preferably includes O-rings.

The first annular fluid chamber 14 contains a hydraulic fluid, such as a light-weight oil or like non-compressible synthetic fluid. Additionally, as more particularly described hereafter, the hydraulic fluid chamber 14 has means provided with the inner and outer tubular elements disposed therein for developing tension and stretch in the drill pipe string connected with the inner tubular element 10 and means for suddenly releasing such tension during upward pulling of the drilling pipe.

A second annular fluid chamber 17 is also provided within the annular space A1 between the inner and outer tubular element 10, 12 which is separate from and spaced longitudinally relative to the first annular fluid chamber 14. The second fluid chamber 17 is defined by a second pair of seal means 18, 19 disposed between the inner and outer tubular elements 10, 12 in sealing engagement therewith and spaced longitudinally relative to each other. The seal means 18 preferably includes an upper annular seal **18*a*, made of suitable conventional seal material such as rubber, teflon, etc. and preferably including an O-ring, disposed within an inwardly facing annular internal groove 12*d* provided adjacent the outer tubular element upper end 12*e*. Similarly, the seal means 19 includes an lower annular seal 19*a*, formed of conventional seal material received in an outwardly facing internal groove 10*b* provided on the inner tubular element 10. The upper and lower annular seals 18*a* and 19*a* slidably engage the respective tubular elements 10, 12 forming fluid tight arrangements therewith for the sealing of a heavy duty special anti-gall lubricating fluid provided within the second fluid chamber 17 so as to isolate the fluid from external well fluids and from the first annular fluid chamber 14. The annular seals 18 and 19 also isolate any foreign particulate matter from the first annular hydraulic fluid chamber 14,** as more particularly explained hereafter.

Both the inner and outer tubular bodies 10, 12 are provided with splined portions, 20, 22, respectively, which are disposed within the second annular fluid chamber 17 and are adapted to engage each other in a rotational interlocking fit to transfer rotational driving forces developed during normal drilling operations from one tubular member to the other. More particularly, the inner tubular body splined portion 20 includes a plurality of longitudinally extending female spline grooves **20*a*, and the outer tubular element splined portion 22 includes an equal plurality of inwardly projecting longitudinally extending male splines 22*a*, disposed within the female spline grooves 20*a*, in an interlocking fit to prevent relative rotational movement between the tubular members 10, 12. Additionally, the female spline grooves 20*a* and interlocking male splines 22*a* extend longitudinally relative to each other to allow free relative longitudinal movement of the inner and outer tubular members 10, 12.**

Further, the inner tubular body 10 is provided with an upwardly facing annular jarring surface or hammer 24 which is disposed above the lower seal 19 substantially adjacent to the lower end of the inner splined portion 20. Similarly, the outer tubular element male splines **22*a* have downwardly facing surfaces provided at their lower end 22*b* which forms an annular jarring or anvil surface 26. As will become more readily apparent hereafter, the inner tubular element hammer or jarring surface 24 and the outer tubular element anvil or jarring surface 26 are adapted to come into jarring contact during the jarring operation of the hydraulic jar section J1 to develop an upwardly directed jarring blow which is transmitted through the outer tubular element 12 to the object to be jarred (FIG. 1A**).

As illustrated in FIGS. 1A and 2A, the splined portion 20, 22 and jarring surfaces 24, 26 of the respective tubular element 10, 12 are disposed within the second annular fluid chamber 17 and are thus continuously bathed in the heavy duty anti-gall lubricating fluid contained therein whereby friction developed during movement of the parts relative to each other is greatly reduced, thus increasing the operational life of the hydraulic jar section J1 of the invention. Additionally, any minute particles of steel generated from the engagement of the splined portions 20, 22 and the contacting of the jarring surfaces 24, 26 are entrapped within the second annular fluid chamber 17 and isolated so as to prevent interference with the fluid restraining means disposed in the separated first annular hydraulic fluid chamber 14. Such arrangement substantially eliminates jarring and/or sticking of the hydraulic jar section J1 during jarring operations.

The above-mentioned means for restraining fluid and suddenly releasing the restraint and tension for causing the upward jarring blow disposed in the first hydraulic fluid chamber 14 includes a piston assembly, generally designated as P, on the inner tubular body 10, which is adapted for longitudinal movement through a restricted bore portion 30 and an enlarged pressure release bore portion 32, both of which are provided on the outer tubular element 12. The enlarged pressure release bore portion 32 is disposed adjacent to the upper end of the restricted bore portion 30 and has a greater inner diameter relative thereto. The restricted bore portion 30 and enlarged pressure release bore portion 32 are disposed between the upper seals 15*a*, 15*b* and the lower floating seal 16 and thus form the outer cylindrical wall 14*a* of the annular hydraulic fluid chamber 14. The piston assembly P serves to provide a restraint during the upward pulling on the inner tubular body 10 relative to the outer tubular body 12 so that tension and stretch is developed in the drilling pipe or tube string connected directly or remotely to the inner tubular body 10 as the piston assembly P moves upwardly through the restriction provided by the restrictive bore portion 30. Such tension is produced by the piston assembly P restraining the flow of the fluid in the annular chamber 14 from the upper side to the lower side of the piston assembly P as it is pulled upwardly. The tension developed is suddenly released when the piston assembly P moves into the enlarged pressure release bore portion 32 whereby fluid rapidly escapes around the piston assembly P. The sudden release of restraint on the piston assembly P and inner tubular body 10 permits the tension and stretch in the drilling pipe string to exert a rapid and sharp upward movement bringing the jarring surfaces 24 and 26 into violent jarring contact and development of an up-blow which is transmitted through the outer tubular element 12 downwardly to the object in the well to be jarred, mentioned hereinbefore. The piston assembly P is also constructed to allow substantially unrestrained relative longitudinal movement between the tubular elements 10, 12 to a fully telescopical position upon lowering the drilling string.

Figure 3:
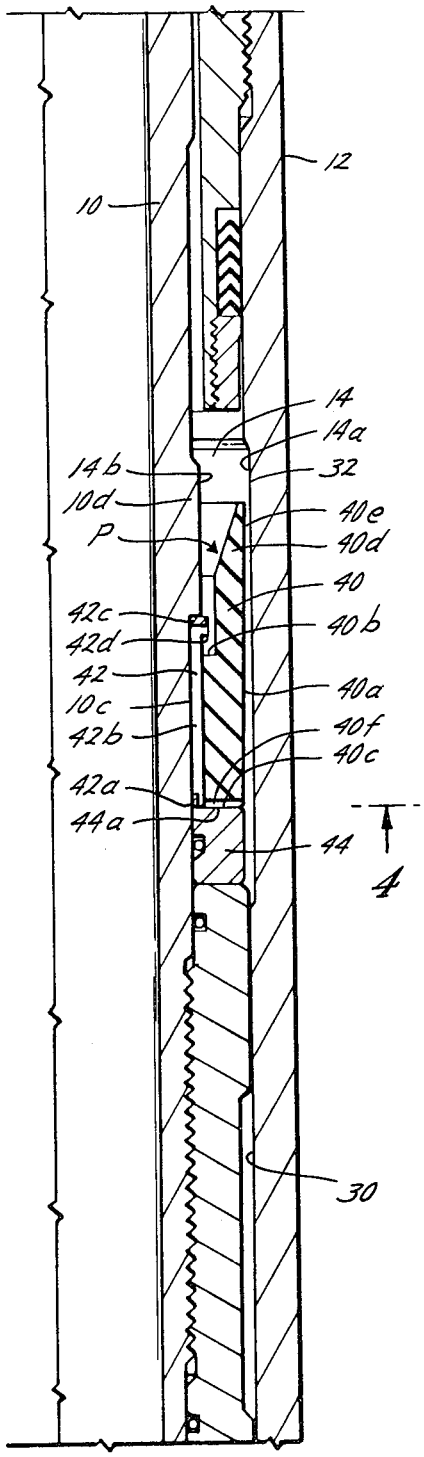
FIG. 3 is a vertical cross-sectional, partial cut-away view of the hydraulic jar section illustrating in detail the fluid restraining means disposed in the first annular fluid chamber.
Figure 4:
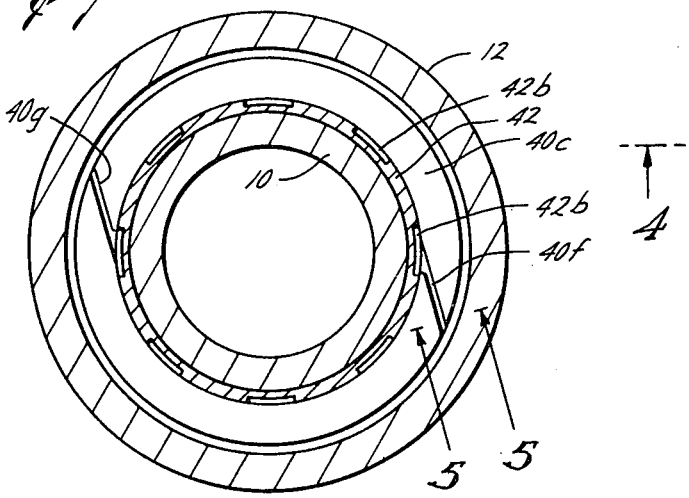
FIG. 4 is a horizontal cross-sectional view taken along line 4—4 of FIG. 3 illustrating the piston assembly of the hydraulically operated jar section.
Figure 5:
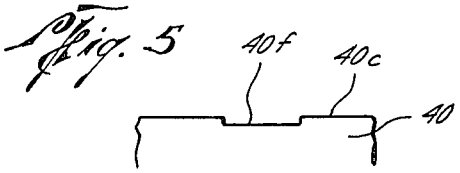
FIG. 5 is a partial vertical cross-sectional view taken along line 5—5 of FIG. 4 illustrating in detail a restricted passageway of the piston assembly of the hydraulically operated jar section.

The piston assembly P is substantially similar, with exceptions noted hereafter, to the piston assembly described in U.S. Pat. No. 3,562,807 issued Feb. 9, 1971 by D. T. Slator, et al., entitled HYDRAULIC JARS which is incorporated herein by reference as if copied in full. Referring now to FIGS. 3, 4 and 5, the piston assembly P includes an annular piston 40 mounted on a by-pass body 42 for limited longitudinal movement relative thereto. The bypass body 42 may be secured to the inner tubular member 10 and disposed in the first hydraulic fluid chamber 14 in any suitable manner described in U.S. Pat. No. 3,562,807. However, it is preferred that the by-pass body be disposed in an annular recessed portion 10*c* on the inner tubular member 10 and secured thereto in any conventional manner to prevent relative longitudinal movement. An annular seal body 44 (FIG. 3) is also preferably disposed within the annular recessed portion 10*c* adjacent the by-pass body lower end 42*a* to prevent fluid from flowing below the by-pass body 42 on the inside thereof.

The by-pass body 42 is provided with a plurality of longitudinal channels 42*b* (FIG. 3) which provide for the passage of sufficient volume of fluid from one side of the piston 40 to the other so that there is substantially no restraint on the longitudinal movement of the inner tubular body 10 relative to the outer tubular body 12 when these channels 42*b* are in the open position. The longitudinal channels 42*b* are preferably connected to each other by an annular channel or the like (not shown) to assure even flow therethrough.

The annular piston 40 has a lower annular portion 40*a* which has an internal diameter slightly larger than the external diameter of the annular by-pass body 42 to provide relative longitudinal movement thereto. However, the by-pass body 42 is provided with an outwardly extending upper annular portion 42*c* forming a downwardly facing annular shoulder 42*d* which limits the upward travel of the piston 40 with respect to the by-pass body 42 by engagement with an upwardly facing annular shoulder 40*b* that defines the upper end of the piston inward portion 40*a*. The downward travel of the piston 40 is limited by sealing engagement of its lower end 40*c* with the upwardly facing annular surface 44*a* of the annular seal body 44.

The piston 40 has an annular upper lip portion 40*d* which is flexible and flared upwardly and outwardly and has a highly polished external surface 40*e*, such as highly polished tool steel, that is machined to have an external diameter equal to or slightly greater than the internal diameter of the outer tubular body restricted bore portion 30 and is machined for close tolerance metal-to-metal contact therewith. The restricted bore portion 30 is also preferably highly polished and made of chrome-plated steel. The outer diameter of the piston lower portion 40*a* is slightly smaller than the restricted bore portion 30 in a tapered arrangement with the upper lip portion outer surface 40*e* so as to minimize frictional contact between the piston 40 and the restricted bore portion 30 while maintaining the metal-to-metal seal therebetween.

Further, the flexibility of the upper lip portion 40*d* maintains a non-binding and non-jamming metal-to-metal seal with the restricted bore portion 30 even during upward movement of the inner tubular body 10 relative to the outer tubular body 12 whereby extremely high internal hydraulic pressures are produced above the piston 40 which causes the restricted bore portion 30 and upper lip portion 40*d* to expand outwardly. Yet, when extremely high well pressures are experienced which may squeeze the restricted bore portion 30 inwardly, the flexible upper lip portion 40*d* may also flex inwardly with the metal-to-metal seal without jamming or sticking.

As illustrated in FIGS. 4 and 5, the piston 40 is provided with a pair of restricted passages 40*f*, 40*g*, disposed on the lower annular piston surface or edge 40*c* which sealably engages the annular seal body upwardly facing surface 44*a* when the piston is in its downward position (FIG. 3). The restricted passages 40*f*, 40*g* provide for the restricted passage of fluid therethrough when the piston 40 is at its lowermost position and moved upwardly through the restricted bore portion 30 (FIG. 2A).

As illustrated in FIG. 4, the restricted bore portions 40*f*, 40*g* extend across the entire width of the piston lower edge 40*c* and are positioned substantially 180° C. opposite each other at angles relative to the piston 40 radius. Further, the restricted passages are extremely wide yet extremely shallow and are made to close tolerances so as to block the entry of any foreign particulate matter, such as minute steel particles (mentioned hereinbefore) within the fluid chamber. More particularly, as illustrated in FIG. 5, the restricted passageways 40*f*, 40*g* have a very shallow depth, for example only about 0.005 inch and a very wide gap or width of approximately 0.050 inch.

Further, the inner tubular element is provided with a lower portion 10*d* of relatively thin-wall construction, as compared with the upper splined portion 20. The upper splined portion 20 and the outer tubular element 12 are of preferably thick-walled construction inasmuch as such members are subjected to heavy forces produced during normal drilling operations and the high forces developed during the jarring stroke. On the other hand, the relatively thin-walled portion 10*d* is subjected only to forces developed during the restrained upward movement of the piston assembly P through the restricted bore 30. The lower portion 10*d* has an outer diameter smaller than the inner diameter of the inner tubular member splined portion 20 and extends longitudinally between the upper seals 15*a*, 15*b* and lower floating seal 16, thus forming the inner cylindrical wall 14*b* of the hydraulic fluid chamber 14. Such an arrangement provides a high pressure zone or detent chamber within the hydraulic fluid chamber 14 between the piston 40 and upper seal 15*b* which has an increased volume area as compared to prior art hydraulic jars which allows the development of very high pull loads on the drilling string at comparatively low hydraulic pressure within the detent chamber during lifting of the drilling string and operating the hydraulic jar section J1 in producing an up-blow.

Figure 2B:
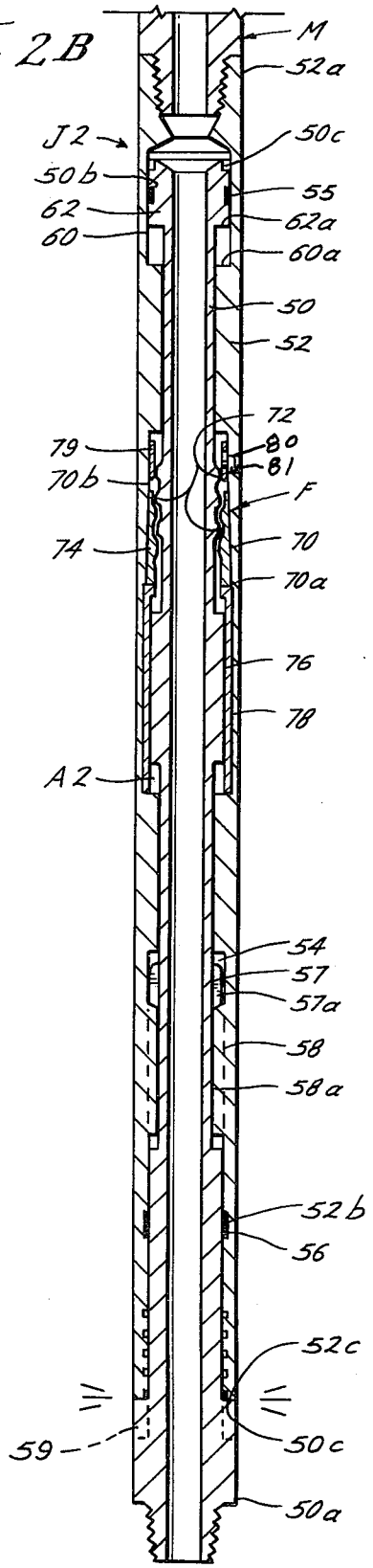
FIG. 2B is a vertical cross-sectional, partial cut-away view of the present invention, illustrating the mechanically operated jar section in its telescopical or jarring position.

Referring now to FIGS. 2A and 2B, the mechanically operated jar section J2 of the present invention comprises the above-mentioned inner and outer telescopically related tubular elements 50, 52 which are adapted for relative longitudinal movement and forming the annular space A2 therebetween. The tubular members may be conveniently constructed of a plurality of parts for ease in assembly, manufacture and maintenance, or as singular elements. A fluid chamber 54 is provided in the annular space A2 between the tubular elements 50, 52 which is defined by an upper annular seal 55 and a lower annular seal 56. The upper annular seal 55 is disposed in an outwardly facing inner annular groove 50*b* provided on the inner tubular element 50 substantially adjacent to its upper end 50*c*. The lower seal 56 is disposed in an inwardly facing annular groove 52*b* provided on the outer tubular element 52 in spaced relationship to its end 52*a*. The annular upper and lower seals 55, 56 slidably engage the respective inner and outer tubular elements 50, 52 to prevent the entry of well fluids into the chamber 54 during relative longitudinal movement of the elements 50, 52 and to confine a lubricating fluid within the chamber, such as a heavy duty anti-gall lubricant.

Splined portions 57, 58 are provided with the tubular elements 50, 52, respectively, which longitudinally slidably engage each other in an interlocking fit to prevent relative rotational movement between the elements and to impart rotational driving forces developed during normal drilling operations from one element to the other. The splined portions 57, 58 are disposed within the fluid chamber 54 and include a plurality of inwardly projecting longitudinally extending male splines 58*a*, on the outer tubular member 52 received in outwardly opening longitudinally extending internal female spline grooves 57*a*, for the interlocking engagement and relative longitudinal movement therein. Inasmuch as the splined portions 57, 58 are disposed within the fluid chamber 54, they are continuously bathed in the special anti-gall lubricant whereby friction developed during relative longitudinal movement is greatly reduced, thereby increasing the operational life of the jar section J2.

The inner tubular member lower end 50*a* has an outer diameter substantially equal to the outer tubular member 52 outer diameter and extends outwardly therefrom. The lower end 50*a* provides an upwardly facing annular shoulder or jarring surface 50*c* which is adapted for jarring contact with a downwardly facing annular jarring surface 52*c* provided on the outer tubular member lower end 52*d* when the tubular elements 50, 52 are moved from a fully extended position (FIG. 2A) to a fully telescoped position (FIG. 2B). Preferably, an annular knocker ring 59 (shown in phantom) is provided on the inner tubular member 50 and disposed on its lower end 50*a*. The annular knocker ring 59 thus forms a part of the lower end 50*a* and has the upwardly facing jarring surface or anvil 50*c* disposed thereon. Additionally, the annular knocker ring 59 is threadably connected with the inner tubular member 50 and adapted for relative longitudinal movement therewith to a contacting position with the outer tubular member lower end 52*d* when the tubular members are in an extended position so as to prevent accidental development of a downward jarring blow when the jar J2 is stored and moved on the surface.

The outer tubular member 52 is further provided with an enlarged bore portion 60 disposed below its upper end 52*a* which has an annular mandrel ring 62 provided on the inner tubular member 50 adjacent its upper end 50*c* disposed therein. The annular mandrel ring 62 has an outer diameter slightly smaller than the inner diameter of the bore portion 60 and is adapted for longitudinal movement therein. The annular mandrel ring 62 is provided with the upper annular seal groove 50*b* having the upper seal 55 disposed therein which slidably engages the enlarged annular bore portion 60 to form a fluid tight seal therebetween. Additionally, the enlarged bore portion 60 and annular mandrel ring 62, respectively, have upwardly facing and downwardly facing annular shoulders 60*a* and 62*a* which are adapted to face each other in spaced relationship when the tubular elements are moved longitudinally to each other.

Figure 6:
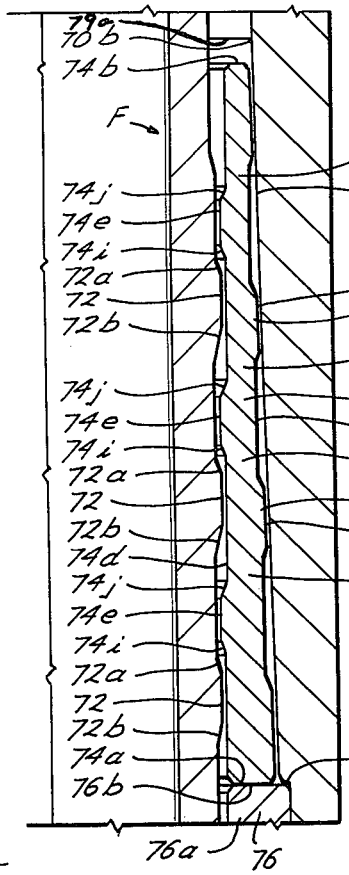
FIG. 6 is a vertical cross-sectional, partial cut-away view of the mechanical jar section illustrating in detail the friction restraining means.

As illustrated in detail in FIG. 6, the means for frictionally restraining relative longitudinal movement of the tubular members 50, 52, indicated generally at F, includes an inwardly and upwardly tapered annular bowl portion 70 provided on the outer tubular member 52, a plurality of outwardly extending annular ridges 72 provided on the inner tubular element 50 adapted for relative longitudinal movement through the tapered bowl portion 70 and an annular friction sleeve 74 disposed between the tapered bowl portion 70 and the inner tubular element 50 and adapted for limited longitudinal movement relative to both members. A longitudinally extending annular spacer sleeve 76 is secured in a second enlarged bore portion 78 provided on the outer tubular member 52 and disposed immediately below and adjacent to the tapered bowl portion lower end 70*a*. The annular spacer sleeve has an inwardly projecting annular shoulder 76*a* at its upper end adjacent to the tapered bowl portion lower end 70*a*. The annular shoulder 76*a* has an inner diameter that is smaller than the inner diameter of the tapered bowl portion lower end 70*a* and thus provides an upwardly facing annular stop surface 76*b* which is adapted to contact the annular friction sleeve lower end 74*a* so as to limit downward longitudinal movement thereof to retain the annular friction sleeve 74 within the tapered bowl portion 70.

An annular control ring 79 is threadably connected with the outer tubular member 52 and disposed in the annular space A2 adjacent to the tapered bowl portion upper end 70*b*. The annular control ring 79 is adapted for adjustable longitudinal movement and has a downwardly facing annular lower edge or surface 79*a* adapted to engage the annular friction sleeve upper end 74*b* to prevent upward longitudinal movement thereof. An opening 80 is provided in the outer tubular member 52 adjacent to the adjustable control ring 79 to provide access thereto. The opening 80 is adapted to receive a threaded protection plug 81. The upward longitudinal movement of the annular friction sleeve 74 within the annular tapered bowl portion 70 may be adjusted by rotating the control ring 80 relative to the outer tubular member 52.

The annular friction sleeve 74 has an inwardly and upwardly tapered outer surface 74*c* of a diameter substantially equal to or slightly greater than the inner diameter of the tapered bowl portion 70, and a substantially cylindrical inner surface 74*d* of a diameter slightly greater than the outer diameters of the plurality of outwardly extending inner tubular member annular ridges 72. A plurality of spaced alternating inwardly projecting and outwardly projecting annular ridges 74*a*, 74*f* are respectively provided on the inner and outer surfaces 74*c*, 74*d*. The spaced alternating inwardly and outwardly projecting annular ridges 74*e*, 74*f* are preferably formed of case hardened steel or the like and are preferably substantially rigid. However, the annular friction sleeve 74 also is provided with flexible annular portions 74*g* disposed between the alternating inwardly and outwardly projecting annular ridges 74*e*, 74*f* which permit the inwardly projecting ridges 74*e* to bend upwardly and downwardly when subjected to predetermined weight loads.

More particularly, the outwardly projecting annular ridges 74*f* have inwardly and upwardly tapered outer surfaces 74*h* which are adapted to engage the tapered bowl portion 70 when the annular friction sleeve 74 is moved upwardly therein. The inwardly projecting annular ridges 74*e* have inner diameters smaller than the outer diameters of the inner tubular member annular ridges 72 and have downwardly facing annular cam surfaces 74*i* adapted for frictional engagement with upwardly facing annular cam surfaces 72*a* provided on the annular ridges 72 when the tubular members 50, 52 are moved longitudinally relative to each other from a fully extended position to a telescopical position. Similarly, the friction sleeve inwardly projecting ridges 74*e* have upwardly facing annular cam surfaces 74*j* adapted for frictional engagement with downwardly facing annular cam surfaces 72*b* provided on the inner tubular member annular ridges 72 when the tubular members 50, 52 are moved longitudinally relative to each other from a fully telescopical position to a fully extended position. Both of these engagements will be more fully explained hereafter in the operation of the jar J2 in developing a downward blow.

In the operation of the novel hydromechanical jar of the present invention, the driller or operator may develop upwardly directed and downwardly directed jarring blows to an object stuck in the well as desired by alternately placing an upward lifting strain or reverse downward force on the drilling string. The operations are the same irrespective of where the hydraulically operated jar section J1 and the mechanically operated jar section J2 are placed in the drilling string. However, as mentioned hereinbefore, it is preferred to employ the inventive combination by connecting the hydraulic jar section J1 to the lower end of the drilling string, connecting the mechanical jar section J2 to a grappler or like device which is connected to the object stuck in the well with the jar sections J1 and J2 connected to each other by one or more joints of flexible drill pipe. Thus, such an arrangement will be described hereafter.

When it is desired to operate the inventive jar, the driller on the surface initially connects the grappler or like device to the object stuck in the well by any conventional technique. Under normal drilling operations or the like the hydraulic jar section J1 and the mechanical jar section J2 of the inventive jar are run in their respective extended positions, as illustrated in FIGS. 1A and 2B. Therefore, in order to initiate an upward blow, the driller initially lowers or relaxes tension on the drilling string a predetermined amount which causes the inner tubular member 10 of the hydraulic jar section J1 to move to a fully telescoped position relative to its outer tubular member 12. Such movement is substantially unrestrained for the piston 40 is caused to move upwardly relative to the by-pass body 42 thereby allowing substantially free flow of the hydraulic fluid in the annular chamber 14 through the by-pass body flow channels 42*c* from the lower side to the upper side of the piston 40. Due to this substantially unrestrained movement, the mechanical jar section J2 remains unaffected and stays in its fully extended position (FIG. 2B). The driller or operator then rapidly lifts the drilling string which causes the piston 40 to move downwardly relative to the by-pass body 42 substantially closing the channels 42*c* and whereby its lower edge 40*c* comes into sealing engagement with the upwardly directed seal body surface 44*a*. As the inner tubular member 10 begins to move upwardly with the lifting of the drilling string, the fluid above the piston 40 within the annular hydraulic fluid chamber 14 is forced through the by-pass body longitudinal passages 42*c* and then through the restricted passages 40*f*, 40*g*. Due to the above-mentioned restricted size of the restricted passages 40*f*, 40*g*, the fluid pressure above the piston 40 increases rapidly thereby restraining the movement of the inner tubular body 10. The restraint increases while the fluid slowly passes through the restricted passages 40*f*, 40*g* which causes the drilling string to stretch and develop a tremendous amount of tension therein. Tension and stretch continues to increase until the piston upper lip portion 40*d* reaches the outer tubular member enlarged pressure release bore portion 32. When that occurs, there is a sudden release of the restraint by the free flow of the fluid around the piston 40 which allows the inner tubular body 10 and the drilling string to move upwardly rapidly as the tension and stretch in the drilling string is released, causing the jarring surfaces 24, 26 to contact each other with a violent jarring blow (FIG. 1A).

Such jarring blow constitutes an upward force which is transmitted to the outer tubular element 12 and thus through the flexible drill pipe connection means M, the mechanical jar section J2 and lower connections of the drilling string to the object stuck in the well.

If such jarring blow does not immediately release the stuck object, and/or it is desired to develop a downward blow, the driller relaxes tension on the drilling string, the weight of which causes a downward force to be placed upon the inventive jar. This downward force initially causes the inner tubular member 10 of the hydraulic jar section J1 to move to the fully telescoped position (FIG. 2A) substantially unrestrained, as described hereinbefore. Substantially simultaneously the outer tubular member 52 of the mechanical hydraulic jar section J2 moves longitudinally downwardly relative to the inner tubular member 50 from the fully extended position (FIG. 1B) towards the fully telescoped position (FIG. 2B). This downward relative longitudinal movement causes the annular ridge upward cam surfaces 72*a* on the inner tubular member 50 to frictionally engage the downwardly facing cam surfaces 74*i* of the inwardly projecting annular friction sleeve ridges 74*e* and move the annular sleeve 74 upwardly whereby the outward projecting ridges 74*f* contact the tapered bore portion 70. The downward force causes the annular friction sleeve 74 to be forced upwardly in frictional contact with the tapered bowl portion 70 and with inward contraction thereof until its upper end 74*b* contacts the annular adjustment ring lower surface 79*a*. The continued downward force provided by the drilling string weight load causes the annular friction sleeve flexible portions 76*g* to flex sufficiently to allow the inward ridges 74*e* to bend outwardly sufficiently when a predetermined weight load is reached to forcibly slip the inner tubular member annular ridges 72 therethrough suddenly freeing the outer tubular member 52 which moves rapidly downwardly, causing the jarring surfaces 50*c* and 52*c* to contact each other with a violent jarring blow (FIG. 2B).

During the frictional contact of the annular friction sleeve 74 with the tapered bowl portion 70 and inner tubular member annular ridges 72, the amount of flexibility provided by the flexible portions 74*g* varies with the distance the friction sleeve moves upwardly relative to the tapered bowl portion 70. As mentioned before, this distance of travel may be adjusted by longitudinally moving the annular control ring upwardly or downwardly relative to the annular bowl portion upper end 70*b* of the tapered bowl portion 70. This adjustment adjusts the weight load required to force the inner tubular member annular ridges 72 through the annular friction sleeve inward ridges 74*e*.

Such jarring blow produced by the mechanical jar section J2 (FIG. 2B) constitutes a downward force which is transmitted to the inner tubular element 50 and thus through the lower connections of the drilling string to the object stuck in the well. If it is desired to develop another downward jarring blow, or to move the mechanical jar section tubular elements 50, 52 back to their relative extended position, the driller places lifting tension on the drilling string whereby the inner tubular member annular ridges 72 contact the friction sleeve inward ridges 74*e* at their respective downwardly facing and upwardly facing cam surfaces 72*b*, 76*j* whereby the friction sleeve 74 is pulled downwardly until its lower end 74*a* contacts the spacer sleeve upper annular surface 76*b*. Inasmuach as the flexibility of the friction sleeve annular flexible portions 74*g* is not limited by contact to the friction sleeve 74 with the tapered bowl portion 70, the inward ridges 74*e* bend outwardly relatively easy allowing the inner tubular member annular ridges 72 to pass therethrough substantially unrestrained. Preferably, the friction sleeve 74 is provided with a plurality of slits (not shown) which extend longitudinally from its upper end 74*b* to a point substantially adjacent its lower end 74*a* to allow it to flare outwardly when it is at its lowermost position thereby allowing the inner tubular member annular ridges 72 to pass therethrough substantially unrestrained.

The foregoing disclosure and description of the invention are illustrative and explanatory thereof, and various changes in the size and shape as well as the details of the illustrative construction may be made without departing from the spirit and scope of the invention.

We claim as our invention:

1. A hydromechanical drilling jar adapted to be connected at one end to a drill string and at an opposite end to an object stuck in a well, said jar comprising:

a. a hydraulically operated jar section adapted to deliver an upward jarring blow to the object stuck in the well upon upward lifting of the drill string, said hydraulic jar section comprising:

inner and outer telescopically related tubular elements movable longitudinally relative to each other, said tubular elements having telescopically overlapping portions providing an annular space therebetween;

jarring surfaces on said tubular elements for jarring contact with each other;

a first pair of annular seal means disposed between said tubular elements and longitudinally spaced relative to each other forming a first annular fluid chamber for confining a hydraulic operating fluid;

fluid restriction means in said first annular fluid chamber for restraining relative longitudinal movement of the tubular elements to an extended position;

means for releasing said fluid restriction means after a predetermined relative movement between said tubular elements for subsequent unrestrained relative movement therebetween until said jarring surfaces engage each other;

a second pair of annular seal means disposed between said tubular elements and longitudinally spaced relative to each other forming a second annular fluid chamber separate from said first annular fluid chamber for confining a lubricating fluid; and rotation means in said second annular fluid chamber for imparting a rotational driving force from one tubular element to the other tubular element and for preventing relative rotational movement while permitting relative longitudinal movement between said tubular elements;

b. a mechanically operated jar section adapted to deliver a downward jarring blow to the object stuck in the well upon reverse lowering of the drill string;

c. means for connecting one of said jar sections to the drill string;

d. means for connecting the other of said jar section to the object stuck in the well; and e. flexible tubular connection means releasably connected between said jar sections for connecting said jar tools to each other for lateral flexibility during the running of said jar in a well.

2. The apparatus of claim 1 wherein:

said hydraulically operated jar section is provided with said means for connecting one of said jar sections to the drill string; and said mechanically operated jar section is provided with said means for connecting said jar tool to the object stuck in the well.

3. The apparatus of claim 1 wherein the flexible tubular connection means for connecting the jar sections to each other includes at least one joint of flexible drill pipe connected with each of said jar sections to provide flexibility therebetween.

4. The apparatus of claim 1 wherein said mechanically operated jar section comprises:

inner and outer telescopically related tubular elements movable longitudinally relative to each other and forming an annular chamber between each other;

jarring surfaces on said tubular elements for jarring contact with each other;

rotation means on said tubular elements for imparting rotational driving forces from one tubular element to the other tubular element and for preventing relative rotational movement while permitting relative longitudinal movement between said tubular elements; and friction means on said tubular elements and disposed in said annular chamber for frictionally restraining the relative longitudinal movement of the tubular elements towards a telescopical position and for releasing said frictional restraint after a predetermined downward weight load on one of said tubular elements is produced for subsequent unrestrained relative movement therebetween until said jarring surfaces engage each other.

* * * * *